US011835921B2

(12) United States Patent
Yamashita

(10) Patent No.: US 11,835,921 B2
(45) Date of Patent: Dec. 5, 2023

(54) CARRIER AND TWO-COMPONENT DEVELOPER

(71) Applicant: KYOCERA Document Solutions Inc., Osaka (JP)

(72) Inventor: Masashi Yamashita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 308 days.

(21) Appl. No.: 17/485,038

(22) Filed: Sep. 24, 2021

(65) Prior Publication Data

US 2022/0100114 A1 Mar. 31, 2022

(30) Foreign Application Priority Data

Sep. 29, 2020 (JP) ..... 2020-163308

(51) Int. Cl.
*G03G 9/113* (2006.01)
*G03G 9/08* (2006.01)

(52) U.S. Cl.
CPC ..... *G03G 9/1139* (2013.01); *G03G 9/0823* (2013.01); *G03G 9/1131* (2013.01)

(58) Field of Classification Search
CPC ..... G03G 9/113; G03G 9/1136; G03G 9/1139
See application file for complete search history.

(56) References Cited

U.S. PATENT DOCUMENTS

2006/0166125 A1* 7/2006 Skorokhod ..... G03G 9/1134 430/111.1

FOREIGN PATENT DOCUMENTS

EP 1 621 935 * 2/2006 ..... G03G 9/107
JP S56-075659 A 6/1981
JP 2014-215484 * 11/2014

OTHER PUBLICATIONS

Translation of JP 2014-215484.*

* cited by examiner

*Primary Examiner* — Peter L Vajda
(74) *Attorney, Agent, or Firm* — Studebaker & Brackett PC

(57) ABSTRACT

A carrier includes carrier particles. Each of the carrier particles includes a carrier core and a coating layer covering the surface of the carrier core. The coating layer contains a silicone resin and conductive particles. Each of the conductive particles includes a transparent conductive substrate composed of a transparent conductive material and a film covering a surface of the transparent conductive substrate. The film contains silica.

7 Claims, 2 Drawing Sheets

CARRIER AND TWO-COMPONENT DEVELOPER

INCORPORATION BY REFERENCE

The present application claims priority under 35 U.S.C. § 119 to Japanese Patent Application No. 2020-163308, filed on Sep. 29, 2020. The contents of this application are incorporated herein by reference in their entirety.

BACKGROUND

The present disclosure relates to a carrier and a two-component developer.

A resin-covered carrier is known. Carrier particles contained in the resin-covered carrier each include a carrier core and a resin layer (coating layer) covering the surface of the carrier core. Furthermore, carbon black is known to be mixed into the coating layer of the resin-covered carrier to adjust the electric resistance of the coating layer.

SUMMARY

A carrier according to an aspect of the present disclosure includes carrier particles. Each of the carrier particles includes a carrier core and a coating layer covering a surface of the carrier core. The coating layer contains a silicone resin and conductive particles. Each of the conductive particles includes a transparent conductive substrate composed of a transparent conductive material and a film covering a surface of the transparent conductive substrate. The film contains silica.

A two-component developer according to another aspect of the present disclosure includes the previously described carrier and a toner including toner particles.

DETAILED DESCRIPTION

Figure 1:
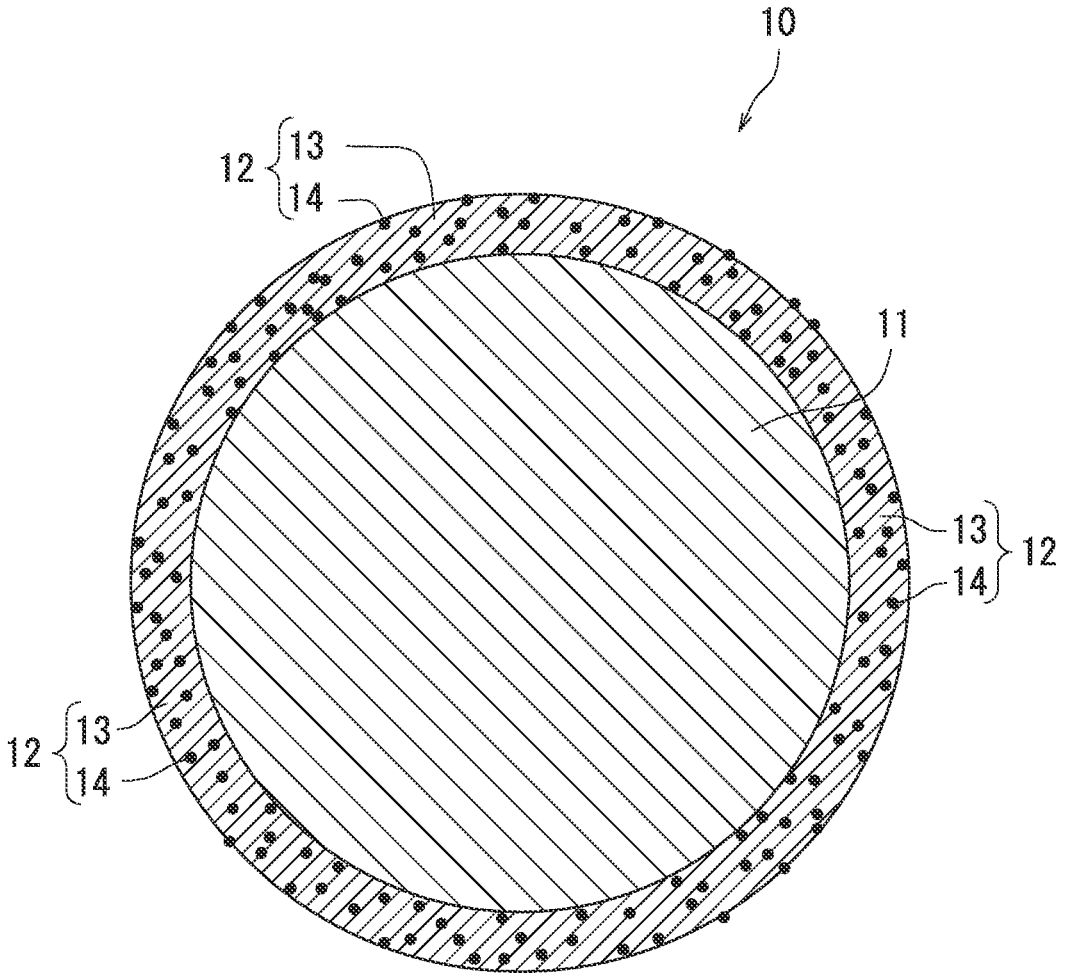
FIG. 1 is a diagram illustrating an example of a cross-sectional structure of a carrier particle included in a carrier according to a first embodiment of the present disclosure.

The following describes preferable embodiments of the present disclosure. First, the terms used in the present specification are defined. A "transparent conductive material" refers to a material exhibiting conductivity and a small absorptance to visible light with a wavelength longer than 400 nm. Here, a material with a small absorptance to visible light with a wavelength longer than 400 nm refers to a material with an optical absorption coefficient to visible light with a wavelength of 500 nm of no greater than 1,000 $cm^{-1}$, for example, and preferably no greater than 500 $cm^{-1}$. A material exhibiting conductivity refers to a material with an electrical resistivity of no greater than $1\times10^{-1}$ Ω·cm, for example, and preferably no greater than $1\times10^{-2}$ Ω·cm.

A carrier is collection (e.g., powder) of carrier particles. A toner is a collection (e.g., powder) of toner particles. An external additive is a collection (e.g., powder) of external additive particles. Evaluation results (values indicating shape, physical properties, or the like) for a powder (specific examples include a toner particle powder, a carrier particle powder, and a conductive particle powder) are number averages of values measured for each of a considerable number of particles selected from the powder unless otherwise stated.

The measurement value for volume median diameter ($D_{50}$) of particles (specifically, a particle powder) is a median diameter in terms of volume measured using a laser diffraction/emulsion particle size distribution analyzer ("LA-950", product of HORIBA, Ltd.) unless otherwise stated. The number average primary particle diameter of the powder is a number average value of equivalent circle diameters of 100 primary particles (Haywood diameter: diameters of circles with the same areas as projected areas of the primary particles) measured using a scanning electron microscope ("JSM-7401F", product of JEOL Ltd.) and image analysis software ("WinROOF", product of MITANI CORPORATION) unless otherwise stated. Note that the number average primary particle diameter of the particles indicates the number average primary particle diameter of the particles in the powder (number average primary particle diameter of the powder) unless otherwise noted.

Chargeability refers to ease of triboelectric charging unless otherwise stated. For example, a measurement target (e.g., a toner) is triboelectrically charged by mixing the measurement target with a standard carrier (standard carrier for a negatively chargeable toner: N-01, standard carrier for a positively chargeable toner: P-01) provided by the Imaging Society of Japan. The charge amount per unit of mass of the measurement target is measured using a compact toner draw-off charge measurement system ("MODEL 212HS", product of TREK, INC.), for example, both before and after triboelectric charging. The chargeability is shown to increase as the change in charge amount per unit of mass of the measurement target between before and after triboelectric charging is increased.

The measurement value for softening point (Tm) refers to a value measured using a capillary rheometer ("CFT-500D", product of Shimadzu Corporation) unless otherwise stated. A temperature corresponding to a stroke value of "(baseline stroke value+maximum stroke value)/2" on an S-shaped curve (horizontal axis: temperature, vertical axis: stroke) plotted using the capillary rheometer corresponds to the Tm (softening point).

In the following, the term "-based" may be appended to the name of a chemical compound in order to form a generic name encompassing both the chemical compound and derivatives thereof.

First Embodiment: Carrier

A carrier according to a first embodiment of the present disclosure may be favorably used to develop an electrostatic latent image. The carrier of the first embodiment positively charges toner, for example, through friction with the toner in a development device.

The carrier of the first embodiment includes carrier particles. Each of the carrier particles includes a carrier core and a coating layer covering the surface of the carrier core. The coating layers contain a silicone resin and conductive particles. Each of the conductive particles includes a transparent conductive substrate composed of a transparent conductive material and a film covering the surface of the transparent conductive substrate. The films contain silica.

By including the above features, the carrier of the first embodiment can enable formation of a high-quality image after printing on a large number of sheets (e.g., 5,000) while a change in the hue between images formed before and after printing on a large number of sheets (e.g., 5,000) can be inhibited. The reasons for this are surmised to be as follows.

The coating layers in the carrier of the first embodiment contain a silicone resin with relatively high hardness. As such, abrasion of the coating layers in the carrier of the first embodiment can be inhibited in printing on a large number of sheets (e.g., 5,000).

The coating layers in the carrier of the first embodiment contain the conductive particles, and the surface layer of each conductive particle is the film containing silica. Silica has a relatively high affinity for silicone resin. As such, the conductive particles can be inhibited from detaching from the coating layers in the carrier of the present embodiment in printing on a large number of sheets (e.g., 5,000). Because of this, the electric resistance of the coating layers in the carrier of the first embodiment can be kept within an appropriate range in printing on a large number of sheets (e.g., 5,000). Therefore, with the carrier of the first embodiment, chargeability can be stably maintained even in printing on a large number of sheets because abrasion of the coating layers in printing on a large number of sheets is inhibited and the electric resistance of the coating layers in printing on a large number of sheets can be kept within an appropriate range.

Accordingly, the carrier of the first embodiment can enable inhibition of occurrence of image defects (specific examples include fogging and decrease in image density) caused by fluctuation in the amount of charge of the toner after printing on a large number of sheets (e.g., 5,000) because fluctuation in the amount of charge of the toner can be inhibited in printing on a large number of sheets (e.g., 5,000). As such, the carrier of the first embodiment can enable formation of a high-quality image after printing on a large number of sheets (e.g., 5,000).

The conductive particles in the coating layers in the carrier of the first embodiment each include the transparent conductive substrate composed of the transparent conductive material. As such, with the carrier of the first embodiment, even when the conductive particles detach from the coating layer in printing on a large number of sheets (e.g., 5,000), the detached conductive particles can be inhibited from color contamination of the toner. Accordingly, the carrier of the first embodiment can enable inhibition of a change in the hue between images formed before and after printing on a large number of sheets (e.g., 5,000).

The amount of conductive particles in the coating layers is preferably at least parts by mass and no greater than 40 parts by mass relative to 100 parts by mass of the silicone resin in the coating layers in order to further form a high-quality image after printing on a large number of sheets while further inhibiting a change in the hue between images formed before and after printing on a large number of sheets.

The following describes the carrier of the first embodiment in detail with reference to the accompanying drawings as appropriate. Note that the referenced drawings illustrate constituent elements schematically to facilitate understanding, and aspects such as size, number, and shape of the constituent elements in the drawings may differ in practice for convenience of drawing preparation.

[Configuration of Carrier Particles]

FIG. 1 is a diagram illustrating an example of a cross-sectional structure of a carrier particle included in the carrier of the first embodiment. As illustrated in FIG. 1, a carrier particle 10 includes a carrier core 11 and a coating layer 12 covering the surface of the carrier core 11. The coating layer 12 contains a silicone resin 13 and a plurality of conductive particles 14.

Figure 2:
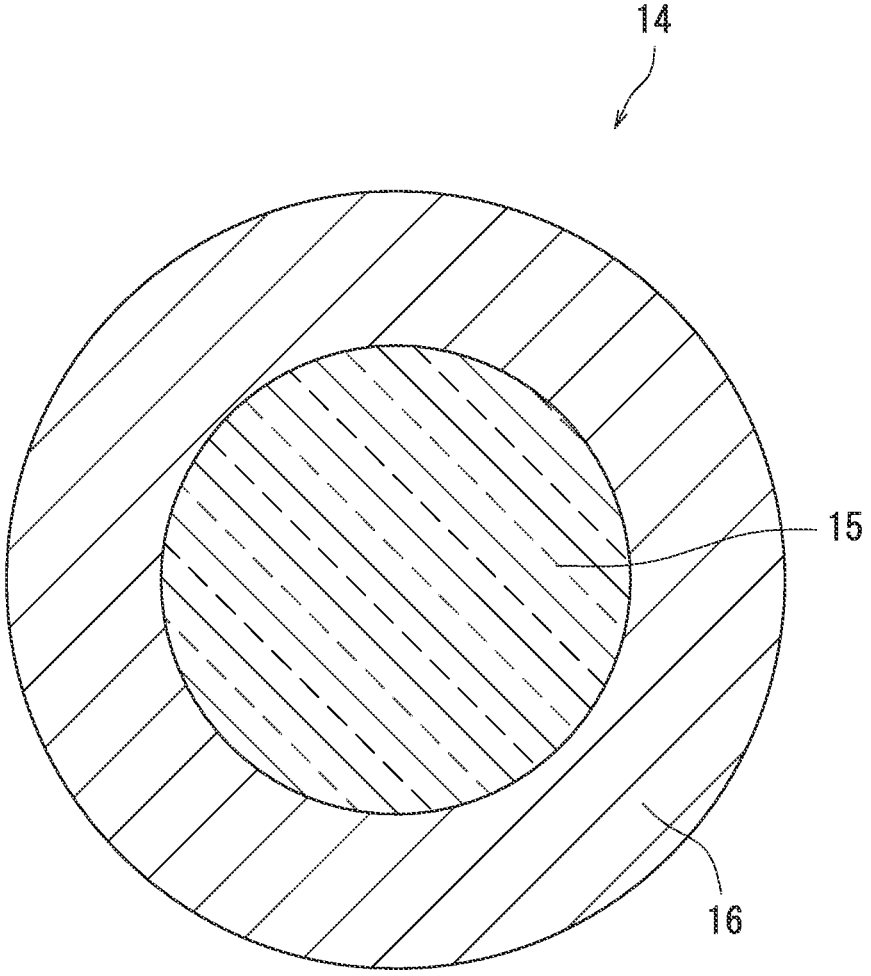
FIG. 2 is a diagram illustrating an example of a cross-sectional structure of a conductive particle included in a coating layer of the carrier particle illustrated in FIG. 1.

FIG. 2 is a diagram illustrating an example of a cross-sectional structure of a conductive particle 14 included in the coating layer 12 of the carrier particle 10 illustrated in FIG. 1. As illustrated in FIG. 2, the conductive particle 14 includes a transparent conductive substrate 15 composed of the transparent conductive material and a film 16 covering the surface of the transparent conductive substrate 15. The film 16 contains silica.

To obtain favorable developability, the coating layer 12 preferably has a thickness of at least 1.5 μm and no greater than 2.5 μm, and more preferably at least 1.7 μm and no greater than 2.1 μm. The measurement method of the thickness of the coating layer 12 is the same method as in later described Examples or an equivalent method.

To obtain favorable developability, the coating layer 12 preferably covers at least 90% and no more than 100% of the surface area of the carrier core 11, and more preferably the entire surface area (100% of the surface area) of the carrier core 11.

To obtain favorable developability, the carrier cores 11 have a volume median diameter ($D_{50}$) of preferably at least 15 μm and no greater than 150 μm, and more preferably at least 20 μm and no greater than 100 μm.

To obtain favorable developability, the saturation magnetization of the carrier cores 11 in an applied magnetic field of 3000 ($10^3/4\pi \cdot A/m$) is preferably at least $30A \cdot m^2/kg$ and no greater than $90A \cdot m^2/kg$, and more preferably at least $40A \cdot m^2/kg$ and no greater than $80A \cdot m^2/kg$.

To further form a high-quality image after printing on a large number of sheets while further inhibiting a change in the hue between images formed before and after printing on a large number of sheets, the number average primary particle diameter of the conductive particles 14 is preferably at least 30 nm and no greater than 70 nm, and more preferably at least 40 nm and no greater than 60 nm.

To further form a high-quality image after printing on a large number of sheets while further inhibiting a change in the hue between images formed before and after printing on a large number of sheets, the film 16 preferably covers at least 90% and no more than 100% of the surface area of the transparent conductive substrate 15, more preferably the entire surface area (100% of the surface area) of the transparent conductive substrate 15.

To further form a high-quality image after printing on a large number of sheets while further inhibiting a change in the hue between images formed before and after printing on a large number of sheets, the thickness of the film 16 is preferably at least 5 nm and no greater than 20 nm, and more preferably at least 10 nm and no greater than nm. The measurement method of the thickness of the film 16 is the same method as in later described Examples or an equivalent method.

An example of the configuration of the carrier particles included in the carrier of the first embodiment is described so far with reference to FIGS. 1 and 2.

[Components of Carrier Particles]

Next, the components of the carrier particles included in the carrier of the first embodiment are described.

(Carrier Core)

The carrier cores preferably contain a magnetic material. The carrier cores may be particles of the magnetic material or carrier cores (may be referred to in the following as resin carrier cores) including a carrier core binder resin and particles of a magnetic material dispersed in the carrier core binder resin.

Examples of the magnetic material contained in the carrier cores include ferromagnetic metals (specific examples include iron, cobalt, nickel, and alloys containing one or more of these metals) and a ferromagnetic metal oxide. Preferable examples of the ferromagnetic metal oxide include ferrite. Preferable examples of the ferrite include Ba ferrite, Mn ferrite, Mn—Zn ferrite, Ni—Zn ferrite, Mn—Mg ferrite. Ca—Mg ferrite, Li ferrite, Cu—Zn ferrite, and Mn—Mg—Sr ferrite. Furthermore, the preferable examples of the ferromagnetic metal oxide also include magnetite which is one type of spinel ferrite. One magnetic material may be used independently as the material of the carrier cores, or a combination of two or more magnetic materials may be used. Examples of a production method of the carrier cores include a method including pulverizing and baking the magnetic material. Note that a commercially available product may be used as the carrier cores.

When the carrier cores are particles of the magnetic material, preferable examples of the particle of the magnetic material include ferrite particles (ferrite cores). Ferrite particles tend to have sufficient magnetism for image formation.

When the carrier cores are resin carrier cores, the carrier core binder resin contained in the resin carrier cores is preferably one or more resins selected from the group consisting of a polyester resin, a urethane resin, and a phenolic resin, and more preferably a phenolic resin. Examples of the particles of the magnetic material dispersed in the carrier core binder resin include one or more types of particles selected from the group consisting of the magnetic materials given as the above examples of the magnetic material, for example.

(Coating Layer)

The coating layers contain a silicone resin and conductive particles. The coating layers may be composed of a silicone resin and conductive particles, or may further include a component other than the silicone resin and the conductive particles. However, to form a further high-quality image after printing on a large number of sheets while further inhibiting a change in the hue between images formed before and after printing on a large number of sheets, the coating layers are preferably composed of a silicone resin and conductive particles. Note that the silicone resin and the conductive particles may be treated with a coupling agent (specific examples include a silane coupling agent and a titanate coupling agent).

To further form a high-quality image after printing on a large number of sheets while further inhibiting a change in the hue between images formed before and after printing on a large number of sheets, the silicone resin is preferably one or more types selected from the group consisting of a methyl silicone resin and a methylphenyl silicone resin, and particularly preferably a methyl silicone resin. The silicone resin has a siloxane bond "Si—O—Si" as a main chain and an organic group as side chains. The methyl silicone resin only has a methyl group as a side chain organic group. The methylphenyl silicone resin only has a methyl group and a phenyl group as side chain organic groups. For the silicone resin to have excellent durability, main chains of the silicone resin (siloxane bond: Si—O—Si) are preferably bonded to each other in a three-dimensional manner.

The transparent conductive substrate, which is a conductive particle substrate, is composed of the transparent conductive material. Examples of the transparent conductive material include a transparent conductive oxide. Specific examples of the transparent conductive oxide include antimony-doped tin oxide (may be referred to in the following as "ATO"), indium-doped tin oxide (may be referred to in the following as "ITO"), niobium-doped tin oxide, tantalum-doped tin oxide, fluorine-doped tin oxide, aluminum-doped zinc oxide, gallium-doped zinc oxide, and niobium-doped titanium dioxide. To further form a high-quality image after printing on a large number of sheets while further inhibiting a change in the hue between images formed before and after printing on a large number of sheets, the transparent conductive material is preferably ATO or ITO, and more preferably ATO.

The film covering the surface of the transparent conductive substrate contains silica. The film may be composed of silica, or may further contain a component other than silica. However, to form a further high-quality image after printing on a large number of sheets while further inhibiting a change in the hue between images formed before and after printing on a large number of sheets, the film is preferably composed of silica.

For example, the conductive particles are obtained by stirring a mixture of the transparent conductive substrates, an alcohol (specific examples include ethanol), a silica source (specific examples include tetraethoxysilane), water (specific examples include ion exchange water), and hydrochloric acid at a rotational speed of at least 120 rpm and no greater than 240 rpm while keeping the mixture at a temperature of at least 25° C. and no higher than 35° C. The stirring time of the mixture is at least 3 hours and no longer than 5 hours, for example. The number average primary particle diameter of the conductive particles and the thickness of the film can be adjusted by for example changing at least one of the amount of the silica source relative to the amount of the transparent conductive substrates, the temperature of the mixture in the stirring, and the stirring time of the mixture.

(Combination of Materials)

To form a further high-quality image after printing on a large number of sheets while further inhibiting a change in the hue between images formed before and after printing on a large number of sheets, the following Condition 1 is preferably satisfied, the following Condition 2 is more preferably satisfied, and the following Condition 3 is even more preferably satisfied.

Condition 1: the coating layers are composed of the methyl silicone resin and the conductive particles.

Condition 2: Condition 1 is satisfied, and the films are composed of silica.

Condition 3: Condition 2 is satisfied, and the transparent conductive substrates are composed of ATO.

[Carrier Production Method]

Next, a preferable production method for the carrier of the first embodiment is described. First, a liquid (may be referred to in the following as a coating liquid) containing coating layer material is sprayed toward the carrier cores using a rolling flow-coating apparatus while the carrier cores are caused to flow. The coating liquid contains a thermosetting silicone resin and the conductive particles, for example. In spraying the coating liquid onto the carrier cores, for example, the thickness of the obtained coating layer is adjusted by changing at least one of the density of the materials (specific examples include the thermosetting silicone resin and the conductive particles) in the coating liquid and a spray amount of the coating liquid. By changing the density of the conductive particles in the coating liquid, the amount of the conductive particles in the obtained coating layers can be also adjusted.

Continuing, a powder of the carrier particles (the carrier) in which the coating layers have covered the surfaces of the carrier cores is obtained by heat treating the carrier cores covered with the coating layers. When the coating layers are formed using the thermosetting silicone resin (silicone resin with a silanol group), a hydroxyl group present on the surface of the silica contained in the films of the conductive particles reacts with the silanol group of the thermosetting silicone resin due to the above heat treatment to form a covalent bond between the silicone resin and the conductive particles. As a result, detachment of the conductive particles from the coating layers is further inhibited.

Second Embodiment: Two-Component Developer

Next, a two-component developer according to a second embodiment of the present disclosure is described. The two-component developer (may be referred to in the following as a developer) of the second embodiment includes a toner and the above-described carrier of the first embodiment. In the following, description of content duplicating that of the first embodiment as described above is omitted.

The toner included in the developer includes toner particles. The toner included in the developer can be used as a positively chargeable toner, for example. A positively chargeable toner is positively charged by friction with the carrier.

The toner particles included in the toner may include an external additive. When the toner particles include the external additive, the toner particles include toner mother particles and the external additive. The external additive attaches to the surfaces of the toner mother particles. The configuration of the toner mother particles is not particularly limited. Note that the external additive may be omitted as necessary. When the external additive is omitted, the toner mother particles correspond to the toner particles.

When the toner particles include the external additive, inorganic particles with a number average primary particle diameter of at least 5 nm and no greater than 30 nm are preferably used as external additive particles to obtain a toner with excellent fluidity.

To cause the external additive to function as a spacer between the toner particles and obtain a toner with excellent heat-resistant preservability, resin particles with a number average primary particle diameter of at least 50 nm and no greater than 200 nm are preferably used as the external additive particles. To cause the external additive to sufficiently demonstrate functionality while inhibiting detachment of the external additive from the toner mother particles, the amount of the external additive is preferably at least 0.5 parts by mass and no greater than 10 parts by mass relative to 100 parts by mass of the toner mother particles.

The toner particles may be toner particles which include no shell layer (non-capsule toner particles) or toner particles which include a shell layer (capsule toner particles). Capsule toner particles each include a toner mother particle including a toner core and a shell layer covering the surface of the toner core. The composition of the toner cores is not particularly limited. The shell layers may be substantially composed only of a thermosetting resin, substantially composed only of a thermoplastic resin, or may contain both of the thermoplastic resin and the thermosetting resin.

To obtain a toner suitable for image formation, the toner mother particles have a volume median diameter ($D_{50}$) of preferably at least 4 μm and no greater than 9 μm.

The developer of the second embodiment can be obtained by stirring and mixing the carrier of the first embodiment and the toner using a mixer (specific examples include a ball mill and a ROCKING MIXER (registered Japanese trademark)), for example. The blending amount of the toner particles is preferably at least 1 part by mass at no greater than 20 parts by mass relative to 100 parts by mass of the carrier particles, and more preferably at least 3 parts by mass and no greater than 15 parts by mass.

Because the developer of the second embodiment as described above includes the carrier of the first embodiment, a high-quality image can be formed after printing on a large number of sheets while a change in the hue between images formed before and after printing on a large number of sheets can be inhibited.

EXAMPLES

The following describes Examples of the present disclosure, but the present disclosure is not limited to the scope of Examples in any sense. Note that the thickness of the coating layers of the carrier particles and the thickness of the films of the conductive particles were measured by the following methods.

<Measurement Method of Carrier Particle Coating Layer Thickness>

After dispersing a powder of the carrier particles (any one of later described carrier particles CA-1 to CA-7 and CB-1 to CB-6) in a visible light photocurable resin ("ARONIX (registered Japanese trademark) LCR D-800", product of Toagosei Co., Ltd.), a hardened material was obtained by hardening the resin through visible light irradiation. Continuing, the obtained hardened material was processed using a knife and a file to obtain a rectangular thin sample with specific dimensions (length: 1 cm, width: 1 cm, thickness: 3 mm). Thereafter, the thin sample was processed under the following conditions using a cross-sectional sample producing apparatus ("CROSS SECTION POLISHER (registered Japanese trademark) SM-09010", product of JEOL Ltd., processing method: ion beam) to obtain cross sections of the carrier particles.

(Processing Conditions)

Ion accelerating voltage: 4.0 kV

Gas used: argon (purity: at least 99.9999%, pressure: 0.15 MPa)

Processing time: 12 hours

An image of the obtained cross sections of the carrier particles was captured at 10,000× magnification using a field emission scanning electron microscope (FE-SEM) ("JSM-7600F", product of JEOL Ltd.).

Continuing, the thickness of each coating layer was measured by analyzing the captured image of the cross sections of the carrier particles using image analysis software ("WinROOF", product of MITANI CORPORATION). In the measurement procedure, 10 carrier particles were first randomly selected in the captured image of the cross sections. The thickness of the coating layers of the respective 10 selected carrier particles was then measured and evaluation values (coating layer thicknesses) of the measurement targets (carrier particles) were collected. More specifically, for 1 carrier particle (cross section), two straight lines were drawn so as to orthogonally intersect at the approximate center of the cross section and the thickness of the coating layer was measured at each of the four points where these two lines intersected with the coating layer. The arithmetic mean value of the four measured thicknesses was taken to be the thickness of the coating layer of the carrier particle. The thicknesses of the coating layers of the 10 selected carrier particles were measured, and the number average value of the 10 obtained measurement values was taken to be an evaluation value (coating layer thickness) of the carrier particles which were measurement targets.

<Measurement Method of Conductive Particle Film Thickness>

Aside from using a powder of conductive particles (any one type of later described conductive particles P1 to P4, P6, and P7) instead of the powder of carrier particles and changing the magnification to 50,000× in capturing an image using the FE-SEM ("JSM-7600F", product of JEOL Ltd.), the thickness of the film of the conductive particles was measured by the same method as in <Measurement Method of Carrier Particle Coating Layer Thickness> described above.

<Production of Conductive Particles>

The following describes production methods of the conductive particles P1 to P4, P6, and P7.

[Production of Conductive Particles P1]

After filling a beaker with 30.0 g of ATO particles ("SN-100P", product of ISHIHARA SANGYO KAISHA, LTD.) as the transparent conductive substrate and 250.0 g of ethanol, the contents of the beaker underwent ultrasonic treatment for 5 minutes using an ultrasonic disperser ("VS-F100" sold by AS ONE Corporation, output: 100 W, oscillation frequency: 50 kHz) to obtain a dispersion. Next, 60.0 g of tetraethoxysilane (product of FUJIFILM Wako Pure Chemical Corporation), 15.0 g of ion exchange water, and 2.0 g of hydrochloric acid (hydrogen chloride density: 0.1 moles/liter) were added to the dispersion in the beaker. Continuing, the contents of the beaker were stirred for 4 hours using a stirrer at a rotational speed of 120 rpm while keeping the contents of the beaker at a temperature of 30° C. using a temperature regulator to form films (specifically, films composed of silica) covering the entire surfaces of the ATO particles. Next, after the contents of the beaker were washed by repetition of decantation and dispersion in ion exchange water and filtered (solid-liquid separation), the obtained solid content was dried for 24 hours in an electric furnace set to a temperature of 80° C. As a result, a powder of the conductive particles P1 including the ATO particles as the transparent conductive substrates and the films (specifically, the films composed of silica) covering the entire surfaces of the ATO particles was obtained.

[Production of Conductive Particles P2]

Aside from changing the amount of tetraethoxysilane (product of FUJIFILM Wako Pure Chemical Corporation) added to the dispersion in the beaker to 75.0 g, a powder of the conductive particles P2 including the ATO particles and the films (specifically, the films composed of silica) covering the entire surfaces of the ATO particles was obtained by the same production method as that for the conductive particles P1.

[Production of Conductive Particles P3]

Aside from changing the amount of tetraethoxysilane (product of FUJIFILM Wako Pure Chemical Corporation) added to the dispersion in the beaker to 45.0 g, a powder of the conductive particles P3 including the ATO particles and the films (specifically, the films composed of silica) covering the entire surfaces of the ATO particles was obtained by the same production method as that for the conductive particles P1.

[Production of Conductive Particles P4]

Aside from using 30.0 g of ITO particles (product of Mitsubishi Materials Corporation) instead of 30.0 g of the ATO particles ("SN-100P", product of ISHIHARA SANGYO KAISHA, LTD.), a powder of the conductive particles P4 was obtained by the same production method as that for the conductive particles P1. The conductive particles P4 included the ITO particles as the transparent conductive substrates and the films (specifically, the films composed of silica) covering the entire surfaces of the ITO particles.

[Production of Conductive Particles P6]

Aside from using 15.0 g of carbon black particles ("#3400B", product of Mitsubishi Chemical Corporation) instead of 30.0 g of the ATO particles ("SN-100P", product of ISHIHARA SANGYO KAISHA, LTD.), a powder of the conductive particles P6 was obtained by the same production method as that for the conductive particles P1. The conductive particles P6 included the carbon black particles and the films (specifically, the films composed of silica) covering the entire surfaces of the carbon black particles.

[Production of Conductive Particles P7]

After filling a beaker with 30.0 g of the ATO particles ("SN-100P", product of ISHIHARA SANGYO KAISHA, LTD.) as the transparent conductive substrate and 200.0 g of ethanol, the contents of the beaker underwent ultrasonic treatment for 5 minutes using an ultrasonic disperser ("VS-F100" sold by AS ONE Corporation, output: 100 W, oscillation frequency: 50 kHz) to obtain a dispersion. Next, 6.3 g of titanium tetra isopropoxide (product of FUJIFILM Wako Pure Chemical Corporation), 1.0 g of ion exchange water, and 3.5 g of hydrochloric acid (hydrogen chloride density: 0.1 mole/L) were added to the dispersion in the beaker. Continuing, the contents of the beaker were stirred for 2 hours using a stirrer at a rotational speed of 120 rpm while keeping the contents of the beaker at a temperature of 25° C. using a temperature regulator to form films (specifically, films composed of titania) covering the entire surfaces of the ATO particles. Next, the contents of the beaker were washed by repetition of decantation and dispersion in ion exchange water and filtered (solid-liquid separation), and the obtained solid content was dried for 24 hours in an electric furnace set to a temperature of 80° C. As a result, a powder of the conductive particles P7 including the ATO particles as the transparent conductive substrates and films (specifically, films composed of titania) covering the entire surfaces of the ATO particles was obtained.

The film thicknesses and number average primary particle diameters of the conductive particles P1 to P4, P6, and P7 are shown in Table 1.

TABLE 1

| Conductive particles | Film thickness [nm] | Number average primary particle diameter [nm] |
|---|---|---|
| P1 | 12 | 44 |
| P2 | 15 | 50 |
| P3 | 10 | 40 |
| P4 | 12 | 54 |
| P6 | 12 | 45 |
| P7 | 13 | 46 |

<Preparation of Conductive Particles P5 and P8>

The carbon black particles ("#3400B", product of Mitsubishi Chemical Corporation) were prepared as conductive particles P5. The ATO particles ("SN-100P", product of ISHIARA SANGYO KAISHA, LTD.) were prepared as conductive particles P8.

<Production of Carrier Particles>

The following describes production methods of carrier particles CA-1 to CA-7 and CB-1 to CB-6.

[Production of Carrier Particles CA-1]

First, the coating liquid containing coating layer material was prepared. In detail, a mixture of 100 parts by mass of a thermosetting methyl silicone resin ("KR-220L", product of Shin-Etsu Chemical Co., Ltd., solid concentration: 100% by mass), 1 part by mass of a titanium-based catalyst ("D-25", product of Shin-Etsu Chemical Co., Ltd.), 25 parts by mass of the conductive particles P1, and 1000 parts by mass of toluene underwent ultrasonic treatment for 10 minutes using an ultrasonic disperser ("VS-F100" sold by AS ONE Corporation, output: 100 W, oscillation frequency 50 kHz) to obtain the coating liquid. Ferrite cores ("EF-35B", product of Powdertech Co., Ltd., volume median diameter ($D_{50}$): 35 μm, saturation magnetization in applied magnetic field of 3000 ($10^3/4\pi \cdot A/m$): 68 $A \cdot m^2/kg$) were also prepared as the carrier cores.

Next, 100 parts by mass of the above ferrite cores were charged into a rolling flow-coating apparatus ("MULTI-PLEX MP-01", product of Powrex Corporation) and parts by mass of the above coating liquid was sprayed toward the ferrite cores while the ferrite cores were caused to flow. Continuing, the ferrite cores covered with the coating liquid were heat treated for 2 hours at a temperature of 280° C. to obtain a powder (carrier) of the carrier particles CA-1 in which the entire surfaces of the ferrite cores were covered with coating layers (layers composed of the methyl silicone resin and the conductive particles P1). In the coating layers of the carrier particles CA-1, the amount of the conductive particles P1 was 25 parts by mass relative to 100 parts by mass of the methyl silicone resin.

[Production of Carrier Particles CA-2]

Aside from changing the usage amount of the conductive particles P1 to 40 parts by mass in preparing the coating liquid, a powder (carrier) of the carrier particles CA-2 in which the entire surfaces of the ferrite cores were covered with the coating layers (layers composed of the methyl silicone resin and the conductive particles P1) was obtained by the same production method as that for the carrier particles CA-1. In the coating layers of the carrier particles CA-2, the amount of the conductive particles P1 was 40 parts by mass relative to 100 parts by mass of the methyl silicone resin.

[Production of Carrier Particles CA-3]

Aside from changing the usage amount of the conductive particles P1 to 10 parts by mass in preparing the coating liquid, a powder (carrier) of the carrier particles CA-3 in which the entire surfaces of the ferrite cores were covered with the coating layers (layers composed of the methyl silicone resin and the conductive particles P1) was obtained by the same production method as that for the carrier particles CA-1. In the coating layers of the carrier particles CA-3, the amount of the conductive particles P1 was 10 parts by mass relative to 100 parts by mass of the methyl silicone resin.

[Production of Carrier Particles CA-4]

Aside from using 25 parts by mass of the conductive particles P2 instead of 25 parts by mass of the conductive particles P1 in preparing the coating liquid, a powder (carrier) of the carrier particles CA-4 in which the entire surfaces of the ferrite cores were covered with coating layers (layers composed of the methyl silicone resin and the conductive particles P2) was obtained by the same production method as that for the carrier particles CA-1. In the coating layers of the carrier particles CA-4, the amount of the conductive particles P2 was 25 parts by mass relative to 100 parts by mass of the methyl silicone resin.

[Production of Carrier Particles CA-5]

Aside from using 25 parts by mass of the conductive particles P3 instead of 25 parts by mass of the conductive particles P1 in preparing the coating liquid, a powder (carrier) of the carrier particles CA-5 in which the entire surfaces of the ferrite cores were covered with coating layers (layers composed of the methyl silicone resin and the conductive particles P3) was obtained by the same production method as that for the carrier particles CA-1. In the coating layers of the carrier particles CA-5, the amount of the conductive particles P3 was 25 parts by mass relative to 100 parts by mass of the methyl silicone resin.

[Production of Carrier Particles CA-6]

Aside from using 200 parts by mass of a thermosetting methylphenyl silicone resin solution ("KR-300", product of Shin-Etsu Chemical Co., Ltd., solid concentration: 50% by mass) instead of 100 parts by mass of the thermosetting methyl silicone resin ("KR-220L", product of Shin-Etsu Chemical Co., Ltd., solid concentration: 100% by mass) and changing the usage amount of toluene to 900 parts by mass in preparing the coating liquid, a powder (carrier) of the carrier particles CA-6 was obtained by the same production method as that for the carrier particles CA-1. In the carrier particles CA-6, the entire surfaces of the ferrite particles were covered with coating layers (layers composed of the methylphenyl silicone resin and the conductive particles P1). In the coating layers of the carrier particles CA-6, the amount of the conductive particles P1 was 25 parts by mass relative to 100 parts by mass of the methylphenyl silicone resin.

[Production of Carrier Particles CA-7]

Aside from using 25 parts by mass of the conductive particles P4 instead of 25 parts by mass of the conductive particles P1 in preparing the coating liquid, a powder (carrier) of the carrier particles CA-7 in which the entire surfaces of the ferrite cores were covered with coating layers (layers composed of the methyl silicone resin and the conductive particles P4) was obtained by the same production method as that for the carrier particles CA-1. In the coating layers of the carrier particles CA-7, the amount of the conductive particles P4 was 25 parts by mass relative to 100 parts by mass of the methyl silicone resin.

[Production of Carrier Particles CB-1]

Aside from using 7 parts by mass of the conductive particles P5 instead of 25 parts by mass of the conductive particles P1 in preparing the coating liquid, a powder (carrier) of the carrier particles CB-1 in which the entire surfaces of the ferrite cores were covered with coating layers (layers composed of the methyl silicone resin and the conductive particles P5) was obtained by the same production method as that for the carrier particles CA-1. In the coating layers of the carrier particles CB-1, the amount of the conductive particles P5 was 7 parts by mass relative to 100 parts by mass of the methyl silicone resin.

[Production of Carrier Particles CB-2]

Aside from using 7 parts by mass of the conductive particles P6 instead of 25 parts by mass of the conductive particles P1 in preparing the coating liquid, a powder (carrier) of the carrier particles CB-2 in which the entire surfaces of the ferrite cores were covered with coating layers (layers composed of the methyl silicone resin and the conductive particles P6) was obtained by the same production method as that for the carrier particles CA-1. In the coating layers of the carrier particles CB-2, the amount of the conductive particles P6 was 7 parts by mass relative to 100 parts by mass of the methyl silicone resin.

[Production of Carrier Particles CB-3]

Aside from using 25 parts by mass of the conductive particles P7 instead of 25 parts by mass of the conductive particles P1 in preparing the coating liquid, a powder (carrier) of the carrier particles CB-3 in which the entire surfaces of the ferrite cores were covered with coating layers (layers composed of the methyl silicone resin and the conductive particles P7) was obtained by the same production method as that for the carrier particles CA-1. In the coating layers of the carrier particles CB-3, the amount of the conductive particles P7 was 25 parts by mass relative to 100 parts by mass of the methyl silicone resin.

[Production of Carrier Particles CB-4]

Aside from using 25 parts by mass of the conductive particles P8 instead of 25 parts by mass of the conductive particles P1 in preparing the coating liquid, a powder (carrier) of the carrier particles CB-4 in which the entire surfaces of the ferrite cores were covered with coating layers (layers composed of the methyl silicone resin and the conductive particles P8) was obtained by the same production method as that for the carrier particles CA-1. In the coating layers of the carrier particles CB-4, the amount of the conductive particles P8 was 25 parts by mass relative to 100 parts by mass of the methyl silicone resin.

[Production of Carrier Particles CB-5]

Aside from using 1000 parts by mass of an alkoxysilyl group-containing polyamideimide resin solution ("COMPOCERAN (registered Japanese trademark) H901-2", product of ARAKAWA CHEMICAL INDUSTRIES, LTD.) diluted to a solid concentration of 10% by mass using dimethyl sulfoxide instead of 100 parts by mass of the thermosetting methyl silicone resin ("KR-220L", product of Shin-Etsu Chemical Co., Ltd., solid concentration: 100% by mass) and using 100 parts by mass of dimethyl sulfoxide instead of 1000 parts by mass of toluene in preparing the coating liquid, a powder (carrier) of the carrier particles CB-5 was obtained by the same production method as that for the carrier particles CA-1. In the carrier particles CB-5, the entire surfaces of the ferrite cores were covered with coating layers (layers composed of the alkoxysilyl group-containing polyamideimide resin and the conductive particles P1). In the coating layers of the carrier particles CB-5, the amount of the conductive particles P1 was 25 parts by mass relative to 100 parts by mass of the alkoxysilyl group-containing polyamideimide resin.

[Production of Carrier Particles CB-6]

Aside from not using the conductive particles P1 in preparing the coating liquid, a powder (carrier) of the carrier particles CB-6 in which the entire surfaces of the ferrite cores were covered with coating layers (layers composed of the methyl silicone resin) was obtained by the same production method as that for the carrier particles CA-1.

<Evaluation Toner Production>

The following describes production methods of evaluation toners. First, a synthesis method of a polyester resin used in the production of a later described first evaluation toner and second evaluation toner is described.

[Polyester Resin Synthesis]

A 5 L-capacity four-necked flask equipped with a thermometer (thermocouple), a drainage tube, a nitrogen inlet tube, a rectification column, and a stirrer was set in an oil bath, and 1200 g of 1,2-propanediol, 1700 g of terephthalic acid, and 3 g of tin (II) dioctanate was charged into the flask. Continuing, the contents of the flask were allowed to react (specifically, condensation react) for 15 hours under a nitrogen atmosphere and a temperature of 230° C. Next, the flask was depressurized and the contents of the flask were allowed to react under conditions of a depressurized atmosphere (8.0 kPa of pressure) and a temperature of 230° C. until the Tm of the reaction product (polyester resin) reached a specific temperature (90° C.). As a result, a polyester resin (Tm: 90° C.) was obtained as a binder resin.

[Production of First Evaluation Toner]

After charging 80 parts by mass of the polyester resin obtained through the previously described procedure, 10 parts by mass of a releasing agent ("NISSAN ELECTOL (registered Japanese trademark) WEP-Y", product of NOF Corporation, component: synthetic ester wax), 9 parts by mass of a colorant ("MA100", product of Mitsubishi Chemical Corporation, component: carbon black), and 1 part by mass of a positively chargeable charge control agent ("BONTRON (registered Japanese trademark) P-51", product of ORIENT CHEMICAL INDUSTRIES, Co., Ltd.) into an FM mixer ("FM-20B", product of Nippon Coke & Engineering Co., Ltd.), these materials were mixed for 4 minutes at a rotational speed of 2000 rpm using the FM mixer.

Continuing, the obtained mixture was melt-kneaded at a material feeding speed of 5 kg/h, a shaft rotational speed of 160 rpm, and a set temperature (cylinder temperature) of 100° C. using a twin screw extruder ("PCM-30", product of Ikegai Corp.). Thereafter, the obtained mixture was cooled. Next, the cooled mixture was pulverized using a mechanical pulverizer ("TURBO MILL T250", product of FREUND-TURBO CORPORATION). Continuing, the obtained pulverized product was classified using a classifying machine ("ELBOW JET EJ-LABO model", product of Nittetsu Mining Co., Ltd.). As a result, toner mother particles with a volume median diameter (Duo) of 6.7 μm were obtained.

Next, 100 parts by mass of the toner mother particles obtained through the previously described procedure, 1.5 parts by mass of hydrophobic silica particles ("AEROSIL (registered Japanese trademark) RA-200HS", product of Nippon Aerosil Co., Ltd.), and 1.0 part by mass of conductive titanium oxide particles ("EC-100", product of Titan Kogyo, Ltd.) were mixed for 5 minutes using an FM mixer ("FM-10B", product of Nippon Coke & Engineering Co., Ltd.) at a rotational speed of 3000 rpm and a jacket temperature of 20° C. Through the above, the total amount of the external additive (hydrophobic silica particles and conductive titanium oxide particles) was attached to the surfaces of the toner mother particles.

Continuing, the obtained particles were sifted using a 200-mesh (75 μm-opening) sieve. As a result, the positively chargeable first evaluation toner (powder of toner particles) was obtained. Note that before and after the sifting, the composition ratio of the components composing the toner was not changed.

[Production of Second Evaluation Toner]

Aside from using 9 parts by mass of a colorant ("SEIKA FAST (registered Japanese trademark) YELLOW 2021", product of Dainichiseika Color & Chemicals Mfg. Co., Ltd., component: C.I. Pigment Yellow 74) instead of 9 parts by mass of the colorant ("MA100", product of Mitsubishi Chemical Corporation, component: carbon black) in mixing the materials using the FM mixer ("FM-20B", product of Nippon Coke & Engineering Co., Ltd.), the positively chargeable second evaluation toner was produced by the same production method as that for the first evaluation toner.

<Developer Preparation>

The following describes preparation methods for developers DA-1 to DA-7 and DB-1 to DB-6.

[Preparation of First Developer DA-1 and Second Developer DA-1]

The first developer DA-1 was prepared by mixing 100 parts by mass of the carrier particles CA-1 with 8 parts by mass of the first evaluation toner obtained through the previously described procedure for 1 hour at a rotational speed of 80 rpm using a powder mixer ("ROCKING MIXER (registered Japanese trademark)", product of AICHI ELECTRIC CO., LTD.). Aside from using 8 parts by mass of the second evaluation toner instead of 8 parts by mass of the first evaluation toner, the second developer DA-1 was prepared by the same preparation method as that for the first developer DA-1. The first developer DA-1 is a developer used for evaluation other than [Hue Change] in later described evaluation methods. The second developer DA-1 is a developer used for evaluation of [Hue Change] in the later described evaluation methods. To avoid redundancy in the following description, the first developer DA-1 may be simply referred to as a "developer DA-1". Likewise, the second developer DA-1 may be simply referred to as a "developer DA-1".

[Preparation of First Developers DA-2 to DA-7 and DB-1 to DB-6]

Aside from the following modification, the first developers DA-2 to DA-7 and DB-1 to DB-6 were prepared by the same preparation method as that for the first developer DA-1. The first developers DA-2 to DA-7 and DB-1 to DB-6 are developers used for evaluation other than [Hue Change] in the later described evaluation methods.

(Modification)

In the preparation of the first developers DA-2 to DA-7 and DB-1 to DB-6, 8 parts by mass of the first evaluation toner were respectively mixed with 100 parts by mass of the carrier particles CA-2 to CA-7 and CB-1 to CB-6 instead of 100 parts by mass of the carrier particles CA-1.

[Preparation of Second Developers DA-2 to DA-7 and DB-1 to DB-6]

Aside from the following modification, the second developers DA-2 to DA-7 and DB-1 to DB-6 were prepared by the same preparation method as that for the second developer DA-1. The second developers DA-2 to DA-7 and DB-1 to DB-6 are developers used for evaluation of [Hue Change] in the later described evaluation methods.

(Modification)

In the preparation of the second developers DA-2 to DA-7 and DB-1 to DB-6, 8 parts by mass of the second evaluation toner were respectively mixed with 100 parts by mass of the carrier particles CA-2 to CA-7 and CB-1 to CB-6 instead of 100 parts by mass of the carrier particles CA-1.

To avoid redundancy in the following description, the first developers DA-2 to DA-7 and DB-1 to DB-6 may be simply referred to as developers DA-2 to DA-7 and DB-1 to DB-6, respectively. Likewise, the second developers DA-2 to DA-7 and DB-1 to DB-6 may be simply referred to as developers DA-2 to DA-7 and DB-1 to DB-6, respectively.

<Evaluation Method>

The following describes evaluation methods for the developers DA-1 to DA-7 and DB-1 to DB-6. Note that in the following, a formed (printed) image refers to an image that has undergone fixing processing unless otherwise noted.

[Hue Change]

A color multifunction peripheral ("TASKalfa 3252ci", product of KYOCERA Document Solutions Inc.) was used as an evaluation apparatus.

The developer (evaluation target: any one of the developers DA-1 to DA-7 and DB-1 to DB-6) was charged into a development device for yellow color of the evaluation apparatus and the second evaluation toner (second evaluation toner obtained through the previously described method) was charged into a toner container for yellow color of the evaluation apparatus. Continuing, the evaluation apparatus was left to stand for 24 hours in an environment at a temperature of 23° C. and a humidity of 50% RH.

Next, a solid image with a size of 25 mm×25 mm was formed on one sheet of paper (A4-sized plain paper: "C$^2$", product of Fuji Xerox Co., Ltd.) in an environment at a temperature of 23° C. and a humidity of 50% RH using the evaluation apparatus having been left to stand for 24 hours. Continuing, L', a', and b' values in the CIE 1976 (L*, a*, b*) color space of the solid image formed on the paper were measured using a reflectance densitometer ("SPECTROEYE (registered Japanese trademark)", product of X-Rite Inc.). In the following, the L*, a*, and b* values thus measured are referred to as initial L*, a*, and b* values, respectively.

Continuing, an image with a coverage rate of 2% was formed continuously on 5,000 sheets of paper (A4-sized plain paper: "C$^2$", product of Fuji Xerox Co., Ltd.) in an environment at a temperature of 23° C. and a humidity of 50% RH using the above evaluation apparatus. Next, a solid image with a size of 25 mm×25 mm was formed on 1 sheet of paper (A4-sized plain paper: "C$^2$", product of Fuji Xerox Co., Ltd.) in an environment at a temperature of 23° C. and a humidity of 50% RH using the above evaluation apparatus. Continuing, the L, a*, and b* values in the CIE 1976 (L*, a*, b*) color space of the solid image formed on the paper were measured using the reflectance densitometer ("SPECTROEYE (registered Japanese trademark)", product of X-Rite Inc.). In the following, the L, a*, and b* values thus measured are referred to as post-printing L*, a*, and b* values, respectively.

A color difference ΔE* represented by the following formula was then calculated, and it was determined that "a change in the hue between the images formed before and after printing on a large number of sheets was inhibited" if the color difference ΔE* was less than 3.0. If the color difference ΔE* was at least 3.0 by contrast, it was determined that "a change in the hue between the images formed before and after printing on a large number of sheets was not inhibited".

$$\text{Color difference } \Delta E^* = \{(\text{Post-printing } L^* \text{ value} - \text{initial } L^* \text{ value})^2 + (\text{post-printing } a^* \text{ value} - \text{initial } a^* \text{ value})^2 + (\text{post-printing } b^* \text{ value} - \text{initial } b^* \text{ value})^2\}^{1/2}$$

[Fogging Density]

A color multifunction peripheral ("TASKalfa 3252ci", product of KYOCERA Document Solutions Inc.) was used as an evaluation apparatus. The developer (evaluation target: any one of the developers DA-1 to DA-7 and DB-1 to DB-6) was charged into a development device for black color of the evaluation apparatus and the first evaluation toner (first evaluation toner obtained through the previously described method) was charged to a toner container for black color of the evaluation apparatus. Next, the evaluation apparatus was left to stand for 24 hours in an environment at a temperature of 35.2° C. and a humidity of 80% RH.

Next, an image with a coverage rate of 5% was continuously formed on 10,000 sheets of paper (A4-sized plain paper: "C$^2$", product of Fuji Xerox Co., Ltd.) in an environment at a temperature of 32.5° C. and a humidity of 80% RH using the evaluation apparatus having been left to stand for 24 hours. Continuing, an image with a coverage rate of 2% was continuously formed on 10,000 sheets of paper (A4-sized plain paper: "C$^2$", product of Fuji Xerox Co., Ltd.) using the above evaluation apparatus. Continuing, an image with a coverage rate of 20% was continuously formed on 100 sheets of paper (A4-sized plain paper: "C$^2$", product of Fuji Xerox Co., Ltd.) using the above evaluation apparatus. Next, a white image was printed on 1 sheet of paper (A4-sized plain paper: "C$^2$", product of Fuji Xerox Co., Ltd.) using the above evaluation apparatus.

The image density (ID) of the obtained white image was measured using a white light photometer ("TC-6DS/A", product of Tokyo Denshoku Co., Ltd.), and a fogging density (FD) was calculated. Note that the fogging density (FD) corresponds to a value obtained by subtracting the image density (ID) of base paper (unprinted paper) from the image density (ID) of the above white image.

If the fogging density (FD) was less than 0.010, it was determined that "fogging was inhibited from occurring after printing on a large number of sheets". If the fogging density (FD) was at least 0.010 by contrast, it was determined that "fogging was not inhibited from occurring after printing on a large number of sheets".

[Image Density]

A color multifunction peripheral ("TASKalfa 3252ci", product of KYOCERA Document Solutions Inc.) was used as an evaluation apparatus. The developer (evaluation target: any one of the developers DA-1 to DA-7 and DB-1 to DB-6) was charged into the development device for black color of the evaluation apparatus and the first evaluation toner (first evaluation toner obtained through the previously described method) was charged into the toner container for black color of the evaluation apparatus. Continuing, the evaluation apparatus was left to stand for 24 hours in an environment at a temperature of 23° C. and a humidity of 50% RH.

Next, an image with a coverage rate of 5% was continuously formed on 50,000 sheets of paper (A4-sized plain paper: "$C^2$", product of Fuji Xerox Co., Ltd.) in an environment at a temperature of 23° C. and a humidity of 50% RH using the evaluation apparatus having been left to stand for 24 hours.

Continuing, a solid image with a size of 25 mm×25 mm was formed on 1 sheet of paper (A4-sized plain paper: "$C^2$", product of Fuji Xerox Co., Ltd.) in an environment at a temperature of 23° C. and a humidity of 50% RH using the above evaluation apparatus. Next, the image density (ID) of the obtained solid image was measured using a reflectance densitometer ("SPECTROEYE (registered Japanese trademark)", product of X-Rite Inc.).

If the image density (ID) was at least 1.20, it was determined that "adequate image density was maintained after printing on a large number of sheets". If the image density (ID) was less than 1.20 by contrast, it was determined that "adequate image density was not maintained after printing on a large number of sheets".

<Evaluation Results>

The types of the carrier particles, the thickness of the coating layers of the carrier particles, the color difference ΔE*, the fogging density (FD), and the image density (ID) of the solid image for each of the developers DA-1 to DA-7 and DB-1 to DB-6 are shown in Table 2.

TABLE 2

| | | Carrier particles | | Color | | |
|---|---|---|---|---|---|---|
| | Developer | Type | Coating layer thickness [μm] | difference ΔE* | Fogging Density | Image Density |
| Example 1 | DA-1 | CA-1 | 1.8 | 1.1 | 0.003 | 1.34 |
| Example 2 | DA-2 | CA-2 | 2.0 | 1.3 | 0.002 | 1.36 |
| Example 3 | DA-3 | CA-3 | 1.7 | 1.0 | 0.002 | 1.24 |
| Example 4 | DA-4 | CA-4 | 1.8 | 1.2 | 0.002 | 1.30 |
| Example 5 | DA-5 | CA-5 | 1.8 | 1.4 | 0.005 | 1.30 |
| Example 6 | DA-6 | CA-6 | 2.1 | 1.2 | 0.004 | 1.31 |
| Example 7 | DA-7 | CA-7 | 1.7 | 1.2 | 0.003 | 1.30 |
| Comparative Example 1 | DB-1 | CB-1 | 1.8 | 3.9 | 0.014 | 1.33 |
| Comparative Example 2 | DB-2 | CB-2 | 1.9 | 3.7 | 0.010 | 1.36 |
| Comparative Example 3 | DB-3 | CB-3 | 1.8 | 1.6 | 0.012 | 1.29 |
| Comparative Example 4 | DB-4 | CB-4 | 1.8 | 1.4 | 0.017 | 1.34 |
| Comparative Example 5 | DB-5 | CB-5 | 2.0 | 1.9 | 0.015 | 1.31 |
| Comparative Example 6 | DB-6 | CB-6 | 1.8 | 0.4 | 0.005 | 1.07 |

In the developers DA-1 to DA-7, the coating layers of the carrier particles included the silicone resin and the conductive particles. In the developers DA-1 to DA-7, the conductive particles in the coating layers included the transparent conductive substrates composed of the transparent conductive material and the films covering the surfaces of the transparent conductive substrates, and the films contained silica.

As shown in Table 2, the color difference ΔE in each of the developers DA-1 to DA-7 was less than 3.0. Therefore, the developers DA-1 to DA-7 inhibited a change in the hue between the images formed before and after printing on a large number of sheets. In each of the developers DA-1 to DA-7, the fogging density (FD) was less than 0.010. Therefore, the developers DA-1 to DA-7 prevented occurrence of fogging after printing on a large number of sheets. In each of the developers DA-1 to DA-7, the image density (ID) was at least 1.20. Therefore, the developers DA-1 to DA-7 maintained adequate image density after printing on a large number of sheets.

In each of the developers DB-1 and DB-2, the conductive particles in the coating layers did not include the transparent conductive substrates. In the developer DB-3, the conductive particles in the coating layers included films, but the films did not contain silica. In the developer DB-4, the conductive particles in the coating layers included no films. In the developer DB-5, the coating layers did not contain the silicone resin. In the developer DB-6, the coating layers did not include the conductive particles.

As shown in Table 2, the color difference ΔE* in each of the developers DB-1 and DB-2 was at least 3.0. Therefore, the developers DB-1 and DB-2 did not inhibit a change in the hue between the images formed before and after printing on a large number of sheets. In each of the developers DB-1 to DB-5, the fogging density (FD) was at least 0.010. Therefore, the developers DB-1 to DB-5 did not inhibit occurrence of fogging after printing on a large number of sheets. In the developer DB-6, the image density (ID) was less than 1.20. Therefore, the developer DB-6 did not maintain adequate image density after printing on a large number of sheets.

From the above results, it is shown that with the carrier and the two-component developer of the present disclosure, a high-quality image can be formed after printing on a large number of sheets while a change in the hue between images formed before and after printing on a large number of sheets can be inhibited.

What is claimed is:

1. A carrier comprising carrier particles, wherein each of the carrier particles includes a carrier core and a coating layer covering a surface of the carrier core, the coating layer contains a silicone resin and conductive particles, each of the conductive particles includes a transparent conductive substrate composed of a transparent conductive material and a film covering a surface of the transparent conductive substrate, and the film contains silica.

2. The carrier according to claim 1, wherein the transparent conductive material is antimony-doped tin oxide or indium-doped tin oxide.

3. The carrier according to claim 1, wherein an amount of the conductive particles in the coating layer is at least 10 parts by mass and no greater than 40 parts by mass relative to 100 parts by mass of the silicone resin.

4. The carrier according to claim 1, wherein the coating layer has a thickness of at least 1.5 μm an no greater than 2.5 μm.

5. The carrier according to claim 1, wherein the conductive particles have a number average primary particle diameter of at least 30 nm and no greater than 70 nm.

6. The carrier according to claim 1, wherein the film has a thickness of at least 5 nm and no greater than 20 nm.

7. A two-component developer comprising:

a toner including toner particles; and the carrier according to claim 1.

* * * * *